US005646585A

United States Patent [19]

Suzuki et al.

[11] Patent Number: 5,646,585

[45] Date of Patent: Jul. 8, 1997

[54] TUNABLE CAVITY RESONATOR FOR A MULTI-CAVITY KLYSTRON

[75] Inventors: Wako Suzuki; Shunji Tsuida, both of Tokyo, Japan

[73] Assignee: NEC Corporation, Tokyo, Japan

[21] Appl. No.: 318,085

[22] Filed: Oct. 5, 1994

[30] Foreign Application Priority Data

Oct. 6, 1993 [JP] Japan ..... 5-249646

[51] Int. Cl.[6] ..... H01P 7/06; H01J 23/20

[52] U.S. Cl. ..... 333/232; 333/233; 315/5.46; 315/5.48; 315/5.54

[58] Field of Search ..... 315/5.39, 5.46, 315/5.47, 5.48, 5.49, 5.53, 5.54; 331/83; 330/44, 45; 333/231, 232, 233

[56] References Cited

U.S. PATENT DOCUMENTS 3,614,518 10/1971 Schmidt ..... 315/5.53

FOREIGN PATENT DOCUMENTS 58-88765 6/1983 Japan .
2-18254 2/1990 Japan .
6036692 2/1994 Japan ..... 315/5.46

*Primary Examiner*—Benny T. Lee
*Attorney, Agent, or Firm*—Sughrue, Mion, Zinn, Macpeak & Seas

[57] ABSTRACT

A simply structured cavity resonator for a multi-cavity klystron which can position a movable tuning element at a location where the element should be located with respect to a widthwise direction of the element. The cavity resonator of the multi-cavity klystron includes a cavity envelope, and a movable tuning element slidable on upper and lower internal surfaces of the cavity envelope. Each of left and right internal surfaces of the cavity envelope have continuously formed first and second areas. A spacing between the first areas of the left and right internal surfaces of the cavity envelope is equal to a width of the movable tuning element, while a spacing between the second areas of the left and right internal surfaces of the cavity envelope is larger than the width of the movable tuning element. The second areas correspond go an available frequency band.

8 Claims, 5 Drawing Sheets

TUNABLE CAVITY RESONATOR FOR A MULTI-CAVITY KLYSTRON

BACKGROUND OF THE INVENTION

1. Field of the Invention

The invention cavity resonator multi-cavity klystron, and more particularly to a multi-cavity klystron having a cavity resonator operated by an induction or L-tuning process.

2. Description of the Related Art

As known to those skilled in the art, a multi-cavity klystron comprises an electron gun transmitting a beam of electrons, a collector which captures the beams of electrons, and a high frequency circuit which interacts with the beam of electrons. The high frequency circuit has a plurality of cavity resonators arranged in series. Each of the cavity resonators in the high frequency circuit is constructed so that a resonance frequency thereof can be varied to vary an amplitude versus frequency characteristic and an available channel of the klystron. As is well known, methods for varying a resonance frequency include C-tuning process wherein a capacity of the resonance cavity is varied, an L-tuning process wherein then induction is varied, and combinations of these two processes. With respect to the electrical characteristic, the L-tuning process is most preferable because a high impedance for the resonance cavity can be obtained.

Hereinbelow will be explained the principle underlying the L-tuning process, with reference to FIGS. 1A and 1B.

FIGS. 1A and 1B are transverse and longitudinal cross-sectional views of a cavity resonator of a conventional multi-cavity klystron. As illustrated, a cavity resonator has a cavity envelope 1 and drift tubes 2 both of which define a resonance cavity 3. In the resonance cavity 3 is inserted a movable tuning element 6 comprising a column-shaped spring carrier 4 having opposite end surfaces **4*b* and 4*c* in parallel to each other (see FIG. 1A). The spring carrier 4 is formed at an outer surface thereof with a spiral, thin groove 4*a* for accommodating a spring therein (see FIG. 1A). In the spiral groove 4*a* is inserted a resilient metal wire 11. Conventionally, a tungsten wire often has been used as the metal wire 11. As illustrated in FIG. 1B, parts of the metal wire 11 which protrude from the spring carrier 4 toward top and bottom of the cavity envelope 1 are in contact with upper and lower internal surfaces 7*a* and 7*b* of the resonance cavity 3. The spring carrier 4 is interposed between parallel plates 8*a* and 8*b* of a tuning element support 8, and is secured to the support by means of a screw 8*c*, as illustrated in FIG. 1. The support 8 is connected to a connecting rod 9, a larger diameter end 9*a* of which is located outside the resonance cavity 3. Around the connecting rod 9 is provided a bellows 10 between the end 9*a* of the connecting rod 9 and the cavity envelope 1**.

In operation of the above mentioned cavity resonator, the connecting rod 9 is axially moved to thereby slide the movable tuning element 6 on the upper and lower internal surfaces **7*a* and 7*b* of the resonance cavity 3. Thus, a volume of the resonance cavity 3 or an inductance can be varied to thereby vary a resonance frequency of the cavity envelope 1**.

Next, it will be explained how the movable tuning element 6 is centered transversely with reference to FIGS. 2A and 2B.

FIGS. 2A and 2B are transverse and longitudinal cross-sectional views illustrating a conventional method disclosed in Japanese Unexamined Patent Public Disclosure No. 2-18254 for transversely centering a movable tuning element. As illustrated, the spring carrier 4 is formed at the end surfaces **4*b* and 4*c* (see FIG. 2A) thereof with recesses 4*d* for receiving springs 12. The springs 12 received in the recesses 4*d* project from the end surfaces 4*b* and 4*c* of the spring carrier 4 and keep in contact with the upper and lower internal surfaces 7*a* and 7*b* (see FIG. 2B) of the cavity envelope 1. The tuning element 6 is hereby transversely centered in the resonator cavity 3**.

FIG. 3 is a longitudinal cross-sectional view illustrating a conventional mechanism disclosed in Japanese Unexamined Patent Public Disclosure No. 58-88765 for tuning a multi-cavity klystron. As illustrated, a multi-cavity klystron is tuned by rotating a tuning screw 17 located outside the cavity envelope 1, which is kept in vacuum, to thereby displace an induction plate 14. The centering of the induction plate 14 is accomplished by coupling a tuning shaft 13 into the tuning element support 8 and also by coupling a tuning stopper 16 into the tuning element support 8.

However, when the aforementioned conventional methods are applied to a multi-cavity klystron having a high frequency greater than 14 GHZ band, for transversely centering the tuning element 6 or the induction plate 14, problems arise, as follows.

A. In the method illustrated in FIGS. 2A and 2B, as a higher frequency is used, a size of the cavity resonator has to be reduced and hence the spring carrier 4 has to be reduced in size as well. As a result, it is impossible to provide a space for attaching the spring 12 to the spring carrier 4.

B. In the method illustrated in FIG. 3, since the centering of the induction plate 14 is accomplished by the tuning screw 17, which is located outside the cavity envelope 1, it is impossible to avoid the generation of play between the tuning screw 17 and the induction plate 14 even if the tuning shaft 13 and the tuning stopper 16 are precisely coupled into the tuning element support 8. As a result, the induction plate 14 is not centered, and accordingly the induction plate 14 often unnecessarily contacts with the left and right internal surfaces of the cavity envelope 1.

SUMMARY OF THE INVENTION

In view of the foregoing problems, it is an object of the present invention to provide a multi:cavity klystron capable of centering a movable tuning element in a cavity envelope by virtue of a simple structure to thereby provide repeatability in the tuning of a multi-cavity klystron.

The invention provides a multi-cavity klystron having a cavity resonator, the cavity resonator including a cavity envelope having upper and lower internal surfaces spaced from each other at regular intervals, and a movable tuning element slidable on the upper and lower internal surfaces of the cavity envelope. Left and right internal surfaces of the cavity envelope define continuously formed first and second areas. A spacing between the left and right internal surfaces of the cavity envelope in the first area is equal to a width of the movable tuning element, and a spacing between the left and right internal surfaces of the cavity envelope in the second area is larger than the width of the movable tuning element. The second area corresponds to an available frequency band.

The invention also provides a multi-cavity klystron having a cavity resonator, the cavity resonator including a cavity envelope having upper and lower internal surfaces spaced from each other at regular intervals, and a movable tuning element slidable on the upper and lower internal surfaces of the cavity envelope. Left and right internal surfaces of the cavity envelope define continuously formed first and second areas. The movable tuning element moves within the first area and is fitted into the cavity envelope, and moves within the second area with left and right sides thereof being spaced from the left and right internal surfaces of the cavity envelope respectively. The second area corresponds to an available frequency band.

The invention further provides a multi-cavity klystron having a cavity resonator, the cavity resonator including a cavity envelope and a movable tuning element axially moving in the cavity envelope. Left and right internal surfaces of the cavity envelope define continuously formed first and second areas. A spacing between the left and right internal surfaces of the cavity envelope in the first area is equal to a width of the movable tuning element, and a spacing between the left and right internal surfaces of the cavity envelope in the second area is larger than the width of the movable tuning element. The second area of the left and right internal surfaces of the cavity envelope correspond to an available frequency band. Upper and lower internal surfaces of the cavity envelope define continuously formed first and second areas. A spacing between the upper and lower internal surfaces of the cavity envelope in the first area is larger than a height of the movable tuning element, and a spacing between the upper and lower internal surfaces of the cavity envelope in the second area is equal to the height of the movable tuning element. The second area of the upper and lower internal surfaces of the cavity envelope is shorter than the second area of the left and right internal surfaces of the cavity envelope by at least a length equal to a half of a difference between the spacing between the first area of the left and right internal surfaces of the cavity envelope in the first area and the spacing between the left and right internal surfaces of the cavity envelope in the second area.

The invention further provides a multi-cavity klystron having a cavity resonator, the cavity resonator including a cavity envelope and a movable tuning element moving in the cavity envelope. Left and right internal surfaces of the cavity envelope define continuously formed first and second areas. The movable tuning element moves within the first area and is fitted into the cavity envelope, and moves within the second areas with left and right sides thereof being spaced from the left and right internal surfaces of the cavity envelope respectively. The second area corresponds to an available frequency band. Upper and lower internal surfaces of the cavity envelope define continuously formed first and second areas. A spacing between the upper and lower internal surfaces of the cavity envelope in the first area is larger than a height of the movable tuning element, and a spacing between the upper and lower internal surfaces of the cavity envelope in the second area is equal to the height of the movable tuning element. The second area of the upper and lower internal surfaces of the cavity envelope is shorter than the second area of the left and right internal surfaces of the cavity envelope by at least a length equal to a half of a difference between the spacing between the left and right internal surfaces of the cavity envelope in the first area and the spacing between said left and right internal surfaces of the cavity envelope in the second area.

The advantages obtained by the aforementioned present invention will be described hereinbelow.

In accordance with the invention having the above mentioned structure, each of the left and right internal surfaces of the cavity envelope has two areas. A spacing between the first areas is equal to a width of the movable tuning element. Thus, the movable tuning element can be centered transversely by fitting the tuning element into the cavity envelope in the first areas. The invention having a simple structure can avoid a dispersion in the centering of the tuning element to thereby provide repeatability in the precise tuning of the tuning element.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1A:
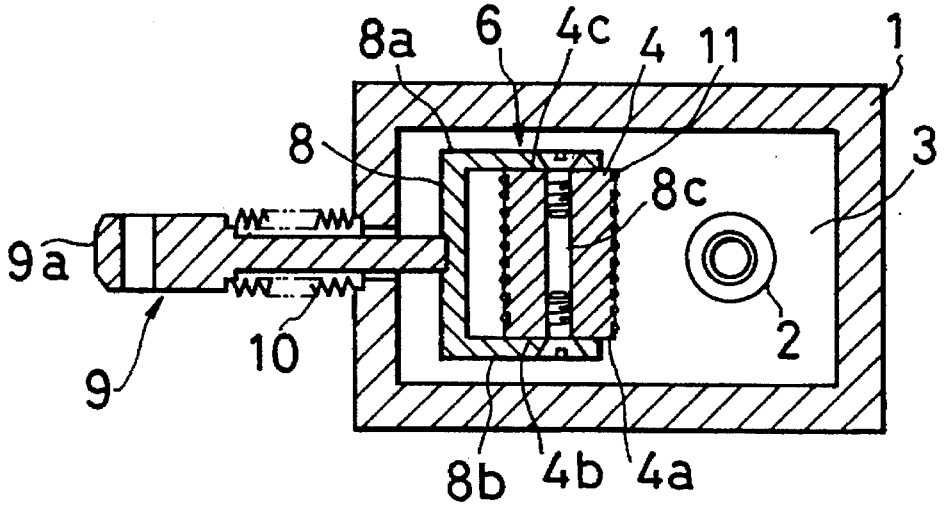
FIG. 1A PRIOR ART
FIGS. 1A and 1B are transverse and longitudinal cross-sectional views, respectively, of a conventional cavity resonator of a multi-cavity klystron.
Figure 1B:
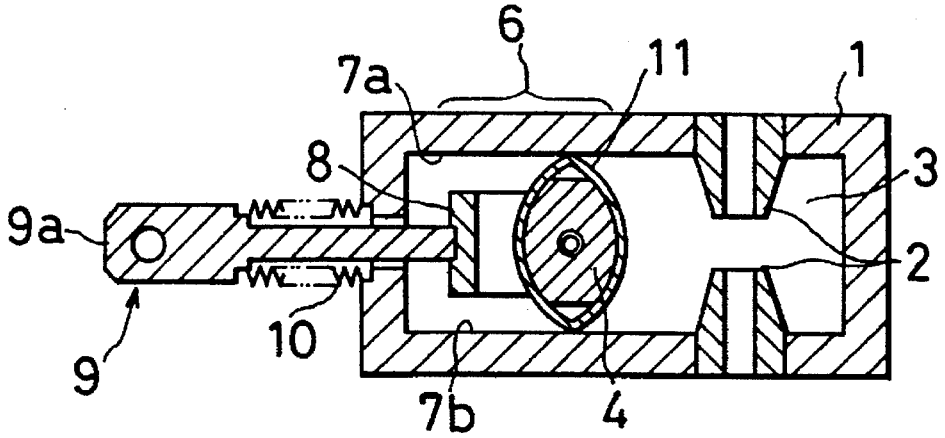
FIG. 1B PRIOR ART
Figure 2A:
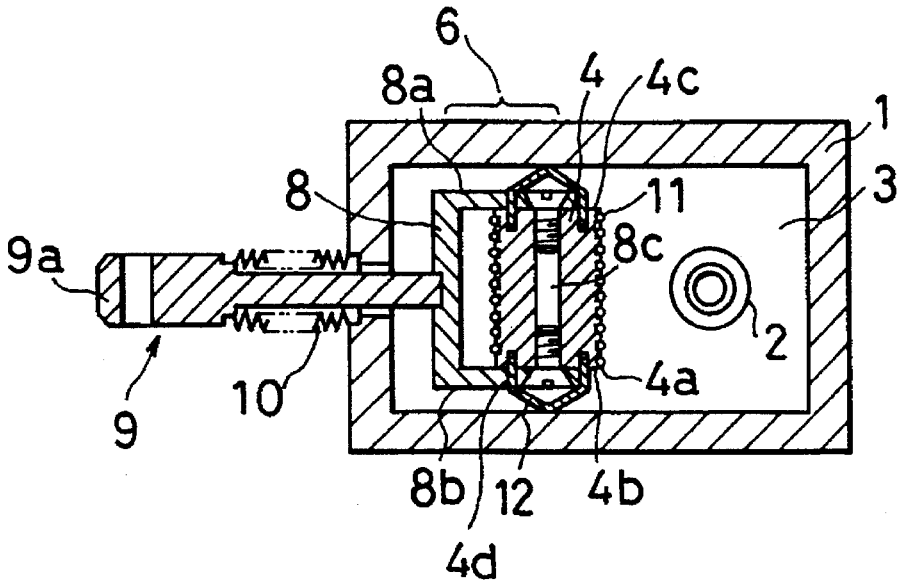
FIG. 2A PRIOR ART
FIGS. 2A and 2B are transverse and longitudinal cross-sectional views, respectively, for explaining a conventional method for transversely, centering a movable tuning element.
Figure 2B:
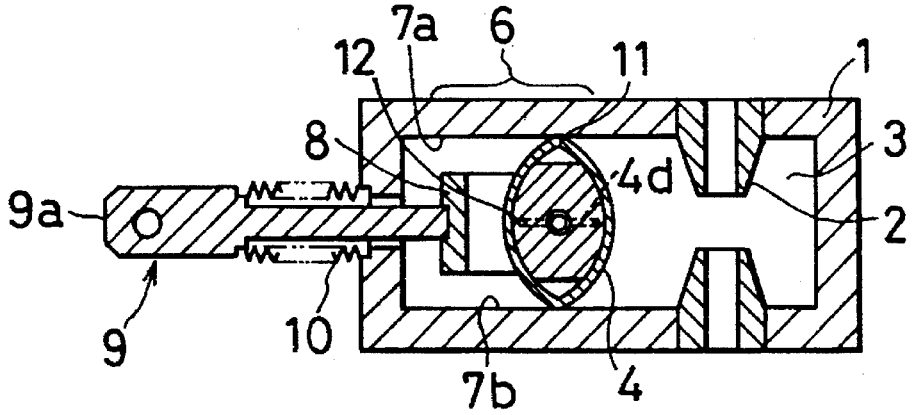
FIG. 2B PRIOR ART
Figure 3:
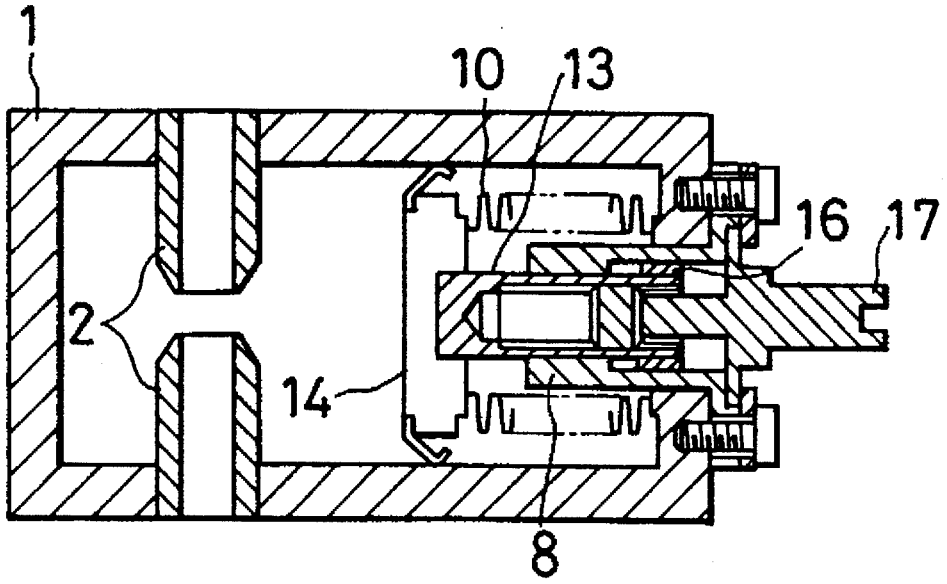
FIG. 3 PRIOR ART
FIG. 3 is a longitudinal cross-sectional view of a conventional mechanism for tuning a multi-cavity klystron.
Figure 4A:
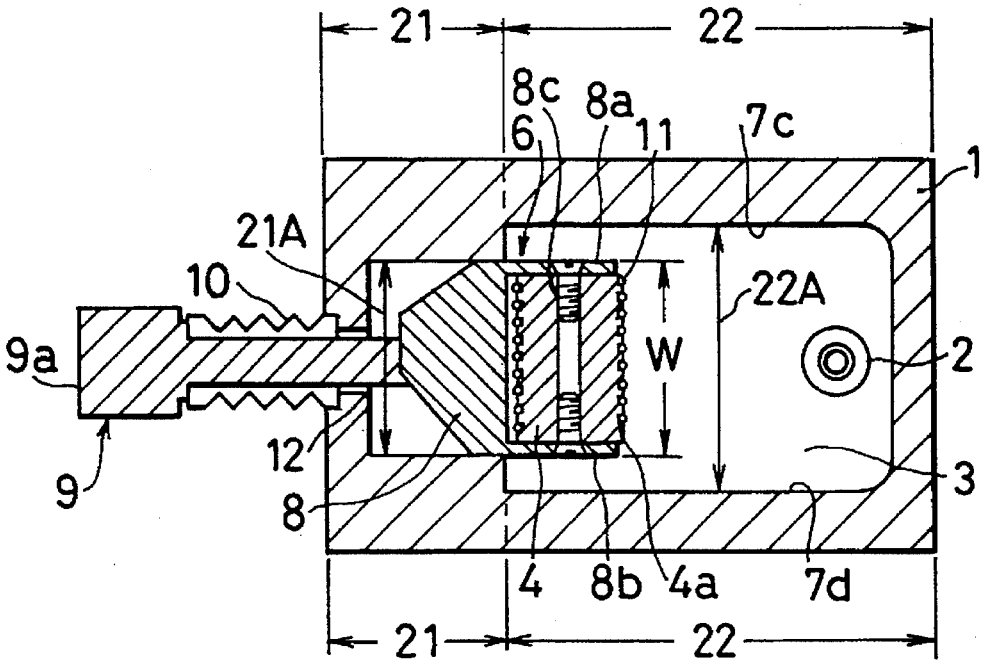
FIGS. 4A and 4B are transverse and longitudinal cross-sectional views, respectively, illustrating a first embodiment in accordance with the invention.
Figure 4B:
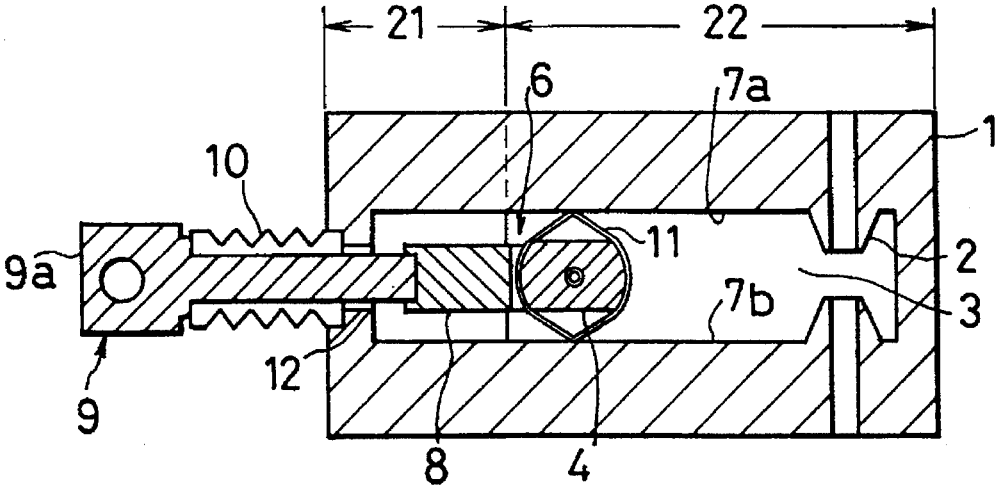

FIGS. 4A and 4B illustrate a first embodiment in accordance with the invention. As illustrated, a cavity resonator has a cavity envelope 1 and drift tubes 2 both of which define a resonance cavity 3. In the resonance cavity 3 is inserted a movable tuning element 6 comprising a column-shaped spring carrier 4 and a support 8 for supporting the spring carrier 4. The spring carrier 4 is formed at an outer surface thereof with a spiral, thin groove **4*a* (see FIG. 4A). In the spiral groove 4*a* is inserted a resilient metal wire 11. As illustrated in FIG. 4B, parts of the metal wire 11 which protrude from the spring carrier 4 toward the top and bottom of the cavity envelope 1 are in contact with upper and lower internal surfaces 7*a* and 7*b* of the cavity envelope 1. The spring carrier 4 is interposed between parallel plates 8*a* and 8*b* of the element support 8, and is secured to the support 8 by means of a screw 8*c* as illustrated in FIG. 4A. The support 8 is connected to a connecting rod 9, a larger diameter end 9*a* of which is located outside the cavity envelope 1. Around the connecting rod 9 is provided a bellows 10 between the end 9*a* of the connecting rod 9 and the cavity envelope 1 for hermetically sealing an opening 12 through which the connecting rod 9 is inserted into the resonance cavity 3**.

As illustrated in FIG. 4A, each of left and right internal surfaces **7*c* and 7*d* of the cavity envelope 1 has a first area 21 and a second area 22 which are continuously formed. The second areas 22 of the left and right internal surfaces 7*c* and 7*d* correspond to an available frequency band. A spacing 21A between the first areas 21 of the left and right internal surfaces 7*c* and 7*d* of the cavity envelope 1 is equal to a width W of the movable tuning element 6, while a spacing 22A between the second areas 22 of the left and right internal surfaces 7*c* and 7*d* of the cavity envelope 1 is larger than the width W of the movable tuning element 6**.

In operation, after the movable tuning element 6 is inserted into the cavity envelope 1, the tuning element 6 is fitted into the cavity envelope 1 in the first areas 21 to thereby be centered in a widthwise direction of the tuning element 6. In addition, since the metal wire 11 is in contact with the upper and lower internal surfaces 7*a* and 7*b* of the cavity envelope 1 in the first and second areas 21 and 22 as illustrated in FIG. 4B, the tuning element 6 is centered in a heightwise direction of the element 6 as well as a widthwise direction of the element 6, even if there is play in other parts of the cavity resonator.

Thus, the movable tuning element 6 is kept uniformly positioned relative to the cavity envelope 1 to thereby make it possible to avoid an electrical discharge in a high frequency between the element 6 and the left and right internal surfaces 7*c* and 7*d* of the cavity envelope 1. Furthermore, the first areas 21 of the left and right internal surfaces 7*c* and 7*d* of the cavity envelope 1 can be formed by adding a step to the internal surfaces 7*c* and 7*d* of a conventional cavity envelope, and hence it is possible to avoid substantial increases in cost for reducing the invention into practice.

Figure 5A:
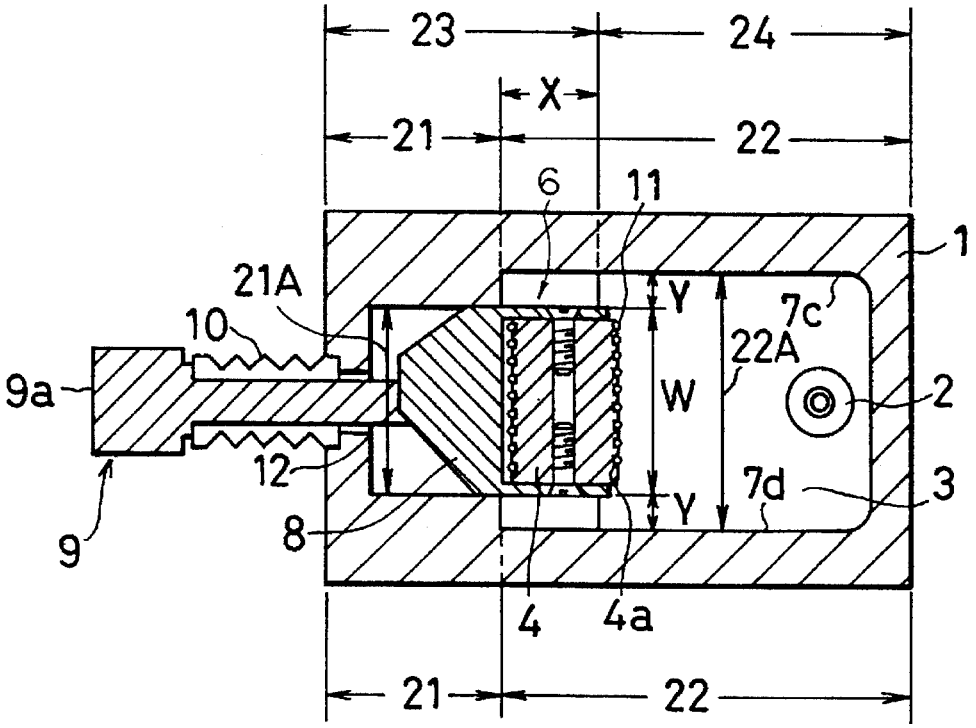
FIGS. 5A and 5B are transverse and longitudinal cross-sectional views, respectively, illustrating a second embodiment in accordance with the invention.
Figure 5B:
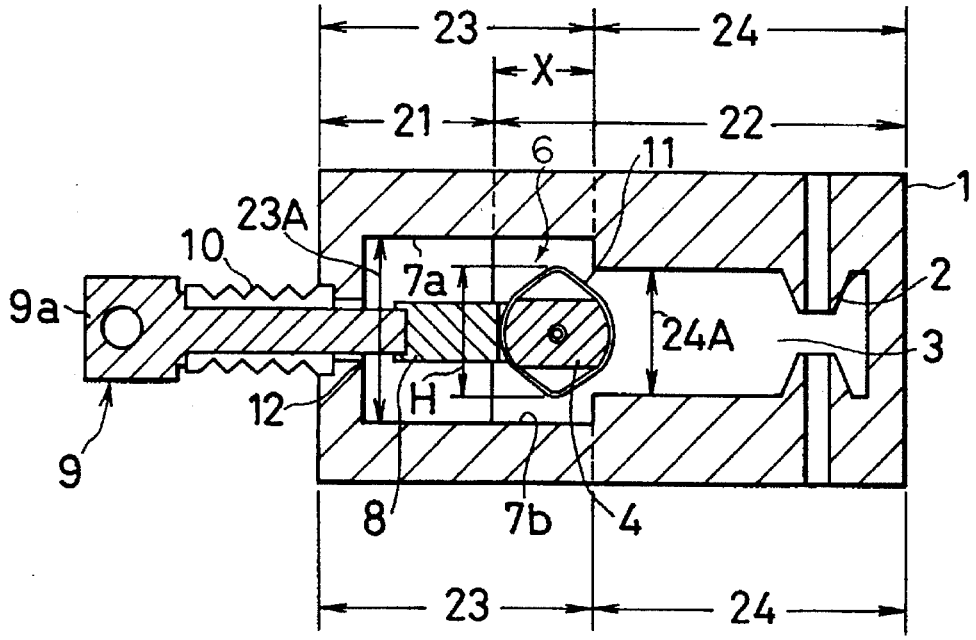

FIGS. 5A and 5B illustrate a second embodiment in which the present invention is applied to a cavity resonator having a cavity envelope 1, disclosed as in Japanese Unexamined Utility Model Public Disclosure No. 51-32260. Similarly to the first embodiment, as illustrated in FIG. 5A, left and right internal surfaces 7*c* and 7*d* of the cavity envelope 1 respectively have a first area 21 and a second area 22 which are continuously formed. The second areas 22 of the left and right internal surfaces 7*c* and 7*d* correspond to an available frequency band. A spacing 21A between the first areas 21 of the left and right internal surfaces 7*c* and 7*d* of the cavity envelope 1 is equal to a width W of the movable tuning element 6, while a spacing 22A between the second areas 22 of the left and right internal surfaces 7*c* and 7*d* of the cavity envelope 1 is larger than the width W of the movable tuning element 6.

In the second embodiment, each of upper and lower surfaces 7*a* and 7*b* of the cavity envelope 1 has a first area 23 and a second area 24 which are continuously formed (see FIG. 5B). A spacing 23A between the first areas 23 of the upper and lower internal surfaces 7*a* and 7*b* of the cavity envelope 1 is larger than a height H of the movable tuning element 6, while a spacing 24A between the second areas 24 of the upper and lower internal surfaces 7*a* and 7*b* of the cavity envelope 1 is equal to the height H of the movable tuning element 6. The reason why the spacing 23A is formed to be larger than the spacing 24A is to avoid the deterioration of resilience of the metal wire 11 which would occur while the tuning element 6 is backwardly moving.

The second areas 24 of the upper and lower internal surfaces 7*a* and 7*b* of the cavity envelope 1 are shorter than the second areas 22 of the left and right internal surfaces 7*c* and 7*d* of the cavity envelope 1 by at least a length equal to a half of a difference between the spacings 21A and 22A (see FIG. 5A). As illustrated in FIGS. 5A and 5B, assuming that a difference in length between the second areas 22 and 24 is denoted by X and a half of a difference between the spacings 21A and 22A is denoted by Y, the relationship between X and Y (see FIG. 5A) is represented by a following equation.

$$X \geqq Y$$

The reason why the second areas 24 of the upper and lower internal surfaces 7*a* and 7*b* is shorter than the second areas 22 of the left and right internal surfaces 7*c* and 7*d* is to avoid an electrical discharge between the movable tuning element 6 and the left and right internal surfaces 7*c* and 7*d* of the cavity envelope 1.

The second embodiment can be applied to a cavity resonator having a space for avoiding the deterioration of resilience of a metal wire, and accordingly provides a more stable multi-cavity klystron than the first embodiment.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A cavity resonator for a multi-cavity klystron, said cavity resonator comprising:

a cavity envelope having upper and lower internal surfaces spaced from each other by a given first interval and having left and right internal surfaces spaced apart from each other by a given second interval; and a movable tuning element slidable on said upper and lower internal surfaces of said cavity envelope and having a given width; wherein:

said left and right internal surfaces of said cavity envelope define therebetween continuously formed first and second areas, a spacing between said left and right internal surfaces of said cavity envelope in said first area being equal to said width of said movable tuning element, and a spacing between said left and right internal surfaces of said cavity envelope in said second area being larger than said width of said movable tuning element.

2. A cavity resonator for a multi-cavity klystron, said cavity resonator comprising:

a cavity envelope having upper and lower internal surfaces spaced apart from each other and having left and right internal surfaces spaced apart from each other; and a movable tuning element having a given width and a given height, and axially movable in said cavity envelope, wherein:

said left and right internal surfaces of said cavity envelope define therebetween continuously formed first and second areas, a spacing between said left and right internal surfaces of said cavity envelope in said first area being equal to said width of said movable tuning element, and a spacing between said left and right internal surfaces of said cavity envelope in said second area being larger than said width of said movable tuning element, said upper and lower internal surfaces of said cavity envelope define therebetween continuously formed third and fourth areas, a spacing between said upper and lower internal surfaces of said cavity envelope in said third area being larger than said height of said movable tuning element, a spacing between said upper and lower internal surfaces of said cavity envelope in said fourth area being equal to said height of said movable tuning element, and respective lengths of said upper and lower internal surfaces of said cavity envelope in said second area being shorter than respective lengths of said left and right internal surfaces of said cavity envelope in said second area by at least a length equal to a half of a difference between said spacing between said left and right internal surfaces of said cavity envelope in said first area and said spacing between said left and right internal surfaces of said cavity envelope in said second area.

3. A cavity resonator for a multi-cavity klystron, said cavity resonator comprising:

a cavity envelope having upper and lower internal surfaces spaced apart from each other and having left and right internal surfaces spaced apart from each other; and a movable tuning element having a given width and height, and movable in said cavity envelope, wherein:

said left and right internal surfaces of said cavity envelope define therebetween continuously formed first and second areas, said movable tuning element being movable within said first area with said tuning element being fitted into said cavity envelope and being movable within said second area with left and right sides thereof being spaced from said left and right internal surfaces of said cavity envelope, said upper and lower internal surfaces of said cavity envelope define therebetween continuously formed third and fourth areas, a spacing between said upper and lower internal surfaces of said cavity envelope in said third area being larger than said height of said movable tuning element, a spacing between said upper and lower internal surfaces of said cavity envelope in said fourth area being equal to said height of said movable tuning element, respective lengths of said upper and lower internal surfaces of said cavity envelope in said fourth area being shorter than respective lengths of said left and right internal surfaces of said cavity envelope in said second area by at least a length equal to a half of a difference between said spacing between said left and right internal surfaces of said cavity envelope in said first area and said spacing between said left and right internal surfaces of said cavity envelope in said second area.

4. In a multi-cavity klystron, a cavity resonator comprising:

a cavity envelope having a first internal surface and a second internal surface opposing the first internal surface, and having a third internal surface and a fourth internal surface opposing the third internal surface; and a movable tuning element movable in said cavity envelope along an axis of movement and having a first dimension transverse to the axis, wherein:

a spacing between the first internal surface and the second internal surface in a first region of said cavity envelope is equal to the first dimension of said movable tuning element; and a spacing between the first internal surface and the second internal surface in a second region of said cavity envelope is greater than the first dimension of said movable tuning element.

5. The cavity resonator according to claim 4, wherein:

said movable tuning element further has a second dimension transverse to the axis;

said cavity envelope further has a third region that at least partially overlaps the first region of said cavity envelope and has a fourth region that at least partially overlaps the second region of said cavity envelope;

a spacing between the third internal surface and the fourth internal surface in the third region of said cavity envelope is equal to the second dimension of said movable tuning element; and a spacing between the third internal surface and the fourth internal surface in the fourth region of said cavity envelope is equal to the second dimension of said movable tuning element.

6. The cavity resonator according to claim 4, wherein:

said movable tuning element further has a second dimension transverse to the axis;

said cavity envelope further has a third region that at least partially overlaps the first region of said cavity envelope and has a fourth region that at least partially overlaps the second region of said cavity envelope;

a spacing between the third internal surface and the fourth internal surface in the third region of said cavity envelope is greater than the second dimension of said movable tuning element; and a spacing between the third internal surface and the fourth internal surface in the fourth region of said cavity envelope is equal to the second dimension of said movable tuning element.

7. The cavity resonator according to claim 6, wherein:

the second region and the third region of said cavity envelope overlap in a fifth region extending along the axis for a length that is equal to at least a half of a difference between (a) the spacing between the first internal surface and the second internal surface in the second region of said cavity envelope and (b) the spacing between the first internal surface and the second internal surface in the first region of said cavity envelope.

8. The cavity resonator according to claim 6, wherein:

the second region and the third region of said cavity envelope overlap in an overlap region extending along the axis for a length that is greater than or equal to X, where:

$$X=(A-B)/2, \text{ and}$$

A=the spacing between the first internal surface and the second internal surface in the second region of said cavity envelope and B=the spacing between the first internal surface and the second internal surface in the first region of said cavity envelope.

* * * * *